US011545325B2

(12) United States Patent
Ikushima et al.

(10) Patent No.: US 11,545,325 B2
(45) Date of Patent: Jan. 3, 2023

(54) ELECTROMAGNETIC RELAY

(71) Applicant: Panasonic Intellectual Property Management Co., Ltd., Osaka (JP)

(72) Inventors: Kimiya Ikushima, Osaka (JP); Takeshi Okada, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/485,070

(22) Filed: Sep. 24, 2021

(65) Prior Publication Data

US 2022/0013315 A1 Jan. 13, 2022

Related U.S. Application Data

(63) Continuation of application No. 16/499,768, filed as application No. PCT/JP2018/009416 on Mar. 12, 2018, now Pat. No. 11,158,474.

(30) Foreign Application Priority Data

Mar. 30, 2017 (JP) ..... JP2017-069103

(51) Int. Cl.

| | |
|---|---|
| ***H01H 50/38*** | (2006.01) |
| ***H01H 50/02*** | (2006.01) |
| ***H01H 50/54*** | (2006.01) |
| *H01H 50/24* | (2006.01) |
| *H01H 50/64* | (2006.01) |

(52) U.S. Cl.

CPC ..... *H01H 50/38* (2013.01); *H01H 50/02* (2013.01); *H01H 50/54* (2013.01); *H01H 50/24* (2013.01);

(Continued)

(58) Field of Classification Search

CPC ..... H01H 50/38; H01H 50/02; H01H 50/24; H01H 50/643

(Continued)

(56) References Cited

U.S. PATENT DOCUMENTS 3,626,132 A 12/1971 Jungels
8,446,235 B2 * 5/2013 Iwamoto ..... H01H 50/56 335/201

(Continued)

FOREIGN PATENT DOCUMENTS

CN 205621691 U 10/2016
EP 2672497 A1 12/2013

(Continued)

OTHER PUBLICATIONS

International Search Report issued in corresponding International Patent Application No. PCT/JP2018/009416, dated Jun. 12, 2018, with English translation.

(Continued)

*Primary Examiner* — Alexander Talpalatski
(74) *Attorney, Agent, or Firm* — McDermott Will & Emery LLP

(57) ABSTRACT

An electromagnetic relay includes a fixed contact holder, a moving contact holder, an electromagnetic device, and a magnet. The fixed contact holder extends in a predetermined direction and is provided with a fixed contact. The moving contact holder also extends in the predetermined direction, and is provided with a moving contact. The magnet is arranged perpendicularly to an opening/closing direction of the fixed contact and the moving contact. A stretch space in which an arc generated between the fixed contact and the moving contact is stretched is provided, in the predetermined direction, beyond respective tips of the fixed contact holder and the moving contact holder. The stretch space also faces a surface of the fixed contact holder and a surface of the moving contact holder.

6 Claims, 8 Drawing Sheets

(52) U.S. Cl.
CPC ..... *H01H 50/643* (2013.01); *H01H 2050/028* (2013.01)

(58) Field of Classification Search
USPC ..... 335/156, 201
See application file for complete search history.

(56) References Cited

U.S. PATENT DOCUMENTS

| | | | | |
|---|---|---|---|---|
| 10,269,519 | B2 * | 4/2019 | Hayashida | H01H 50/54 |
| 10,636,602 | B2 * | 4/2020 | Iwamoto | H01H 50/38 |
| 2009/0134962 | A1 | 5/2009 | Nishida | |
| 2014/0159837 | A1 | 6/2014 | Hiraiwa et al. | |
| 2017/0301495 | A1 * | 10/2017 | Hayashida | H01H 9/443 |

FOREIGN PATENT DOCUMENTS

| | | | |
|---|---|---|---|
| EP | 3147920 | B1 | 12/2018 |
| JP | S49-026379 | B1 | 7/1974 |
| JP | S51-11173 | A | 1/1976 |
| JP | S57-7115 | U | 1/1982 |
| JP | H07-220549 | A | 8/1995 |
| JP | 2007-073308 | A | 3/2007 |
| JP | 2012-142195 | A | 7/2012 |
| JP | 2013-080692 | A | 5/2013 |
| JP | 2014-116165 | A | 6/2014 |
| JP | 2015-035414 | A | 2/2015 |

OTHER PUBLICATIONS

Chinese Office Action and Search Report issued in corresponding Chinese Patent Application No. 201880021247.8, dated May 7, 2021, with English translation.

Notice of Allowance issued in U.S. Appl. No. 16/499,768, dated Jun. 24, 2021.

Notice of Reasons for Refusal dated Mar. 1, 2022 issued in the corresponding Japanese Patent Application No. 2021-101010, with English translation.

* cited by examiner

ELECTROMAGNETIC RELAY

CROSS-REFERENCE OF RELATED APPLICATIONS

This application is the continuation of U.S. application Ser. No. 16/499,768, filed on Sep. 30, 2019, which is the U.S. National Phase under 35 U.S.C. § 371 of International Patent Application No. PCT/JP2018/009416, filed on Mar. 12, 2018, which in turn claims the benefit of Japanese Application No. 2017-069103, filed on Mar. 30, 2017, the entire disclosures of which Applications are incorporated by reference herein.

TECHNICAL FIELD

The present invention generally relates to an electromagnetic relay, and more particularly relates to an electromagnetic relay with the ability to cut off a direct current with high voltage.

BACKGROUND ART

An electromagnetic relay with the ability to cut off a direct current with high voltage has been known in the art (see, for example, Patent Literature 1). The electromagnetic relay described in Patent Literature 1 is designed to extinguish an arc, generated between a fixed contact and a moving contact, by stretching the arc along the width of (i.e., laterally with respect to) a contact spring.

According to Patent Literature 1, the arc generated between the fixed contact and the moving contact is stretched laterally along the width of the contact spring. At this time, stretching the arc along the width of the contact spring requires providing an arc path space in the gap between an end of the contact spring along its width and a case. When such an electromagnetic relay is used in a DC circuit with high voltage, however, sometimes the arc could not be cut off with stability, thus possibly affecting the stability of operation of the electromagnetic relay.

CITATION LIST

Patent Literature

Patent Literature 1: JP 2012-142195 A

SUMMARY OF INVENTION

In view of the foregoing background, it is therefore an object of the present invention to provide an electromagnetic relay with improved ability to cut off an arc with good stability.

An electromagnetic relay according to an aspect of the present invention includes a fixed contact holder, a moving contact holder, an electromagnetic device, and a magnet. The fixed contact holder extends in a predetermined direction and is provided with a fixed contact at one end portion thereof. The moving contact holder also extends in the predetermined direction, is arranged to face the fixed contact holder, and is provided with a moving contact at one end portion thereof. The moving contact holder moves between a closed position where the moving contact comes into contact with the fixed contact and an open position where the moving contact goes out of contact with the fixed contact. The electromagnetic device displaces the moving contact holder such that the moving contact moves back and forth between the closed position and the open position. The magnet is arranged perpendicularly to an opening/closing direction of the fixed contact and the moving contact. A stretch space is provided, in the predetermined direction, beyond respective tips of the fixed contact holder and the moving contact holder. The stretch space is provided to face one surface, out of two surfaces of, the fixed contact holder along the thickness thereof. The one surface of the fixed contact holder is located opposite from the other surface thereof where the fixed contact and the moving contact come into contact with each other. The stretch space is also provided to face one surface, out of two surfaces of, the moving contact holder along the thickness thereof. The one surface of the moving contact holder is located opposite from the other surface thereof where the fixed contact and the moving contact come into contact with each other. The stretch space is a space in which an arc generated between the fixed contact and the moving contact is stretched.

The present invention provides an electromagnetic relay with improved ability to cut off an arc with good stability.

DESCRIPTION OF EMBODIMENTS

Figure 1:
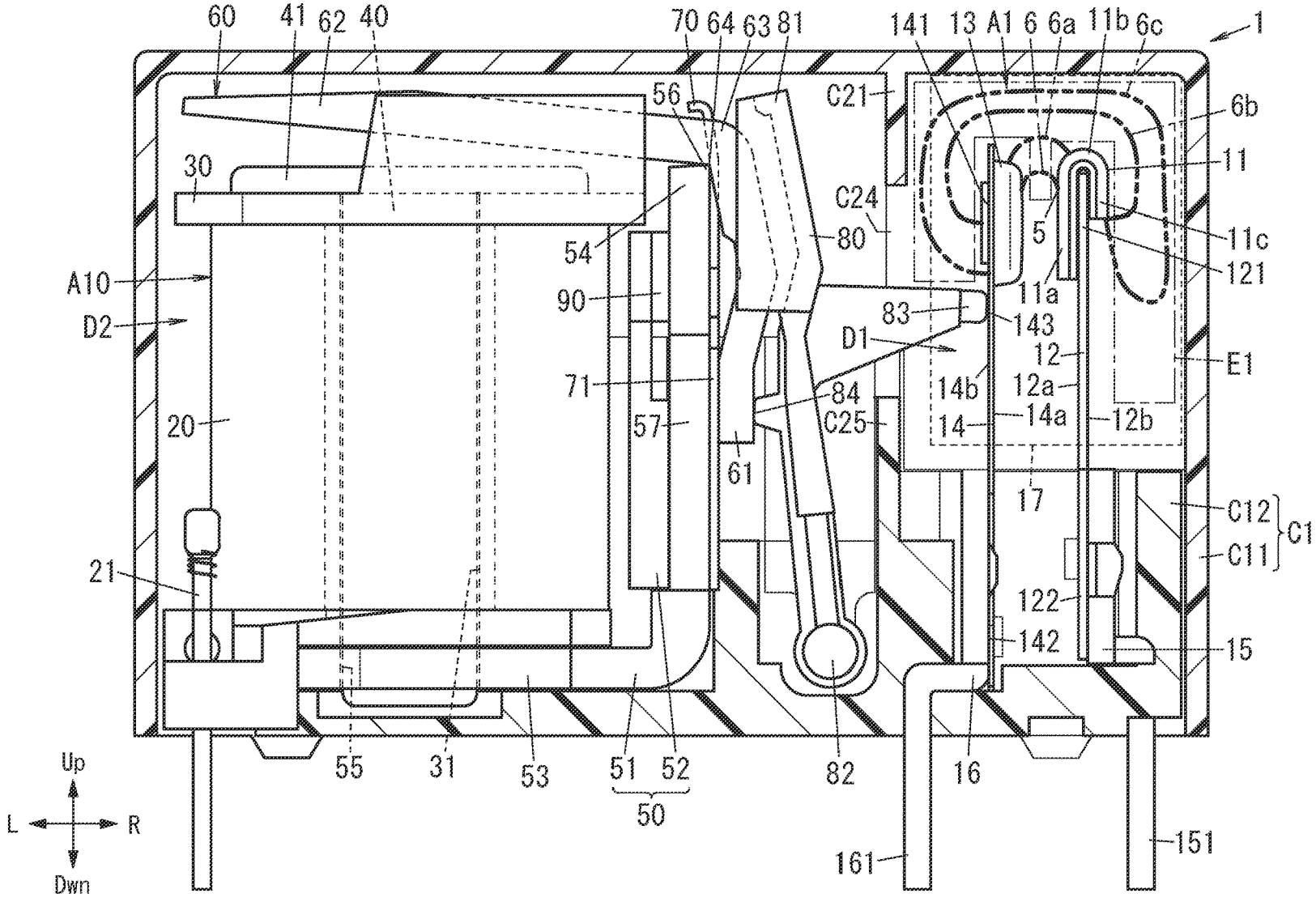
FIG. 1 is a cross-sectional view of an electromagnetic relay according to an embodiment of the present invention.

Note that embodiments and their variations to be described below are only examples of the present invention and should not be construed as limiting. Rather, those embodiments and variations may be readily modified in various manners, depending on a design choice or any other factor, without departing from a true spirit and scope of the present invention.

(Embodiments)

An electromagnetic relay 1 according to an exemplary embodiment will be described with reference to FIGS. 1-8D.

In the following description, the direction in which a moving contact 13 and a fixed contact 11 face each other will be hereinafter referred to as a "rightward/leftward direction." The direction pointing from an end portion 122 of a fixed contact holder 12 toward the fixed contact 11 will be hereinafter referred to as an "upward direction," and the direction pointing from the fixed contact 11 toward the end portion 122 will be hereinafter referred to as a "downward direction."

In the following description, the upward/downward direction will be hereinafter also referred to as a "first axis direction," the rightward/leftward direction will be hereinafter also referred to as a "second axis direction," and a direction perpendicular to both the first axis direction and the second axis direction will be hereinafter also referred to as a "third axis direction."

Figure 4:
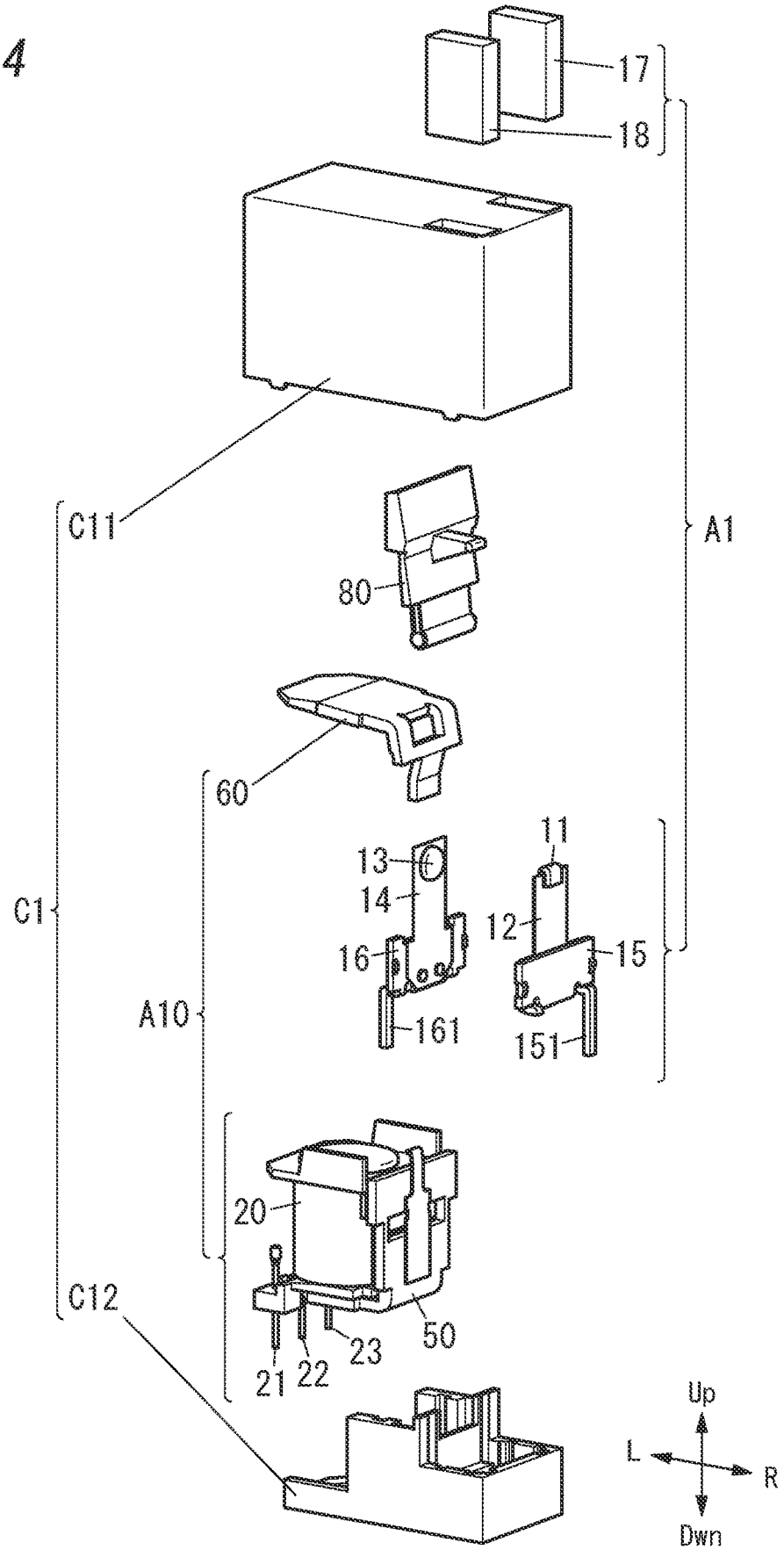
FIG. 4 is an exploded perspective view of the electromagnetic relay.

Note that even though arrows indicating these directions (namely, upward, downward, leftward, and rightward directions) are shown in FIGS. 1 and 4, these arrows are just shown there as an assistant to description and are insubstantial ones. It should also be noted that these directions do not define how the electromagnetic relay 1 according to this embodiment should be used.

<Overall Configuration of this Embodiment>

As shown in FIGS. 1-4, the electromagnetic relay 1 includes the fixed contact holder 12 provided with the fixed contact 11, a moving contact holder 14 provided with a moving contact 13, a first terminal plate 15, a second terminal plate 16, a coil 20, an armature 60, and a card 80.

Figure 3B:
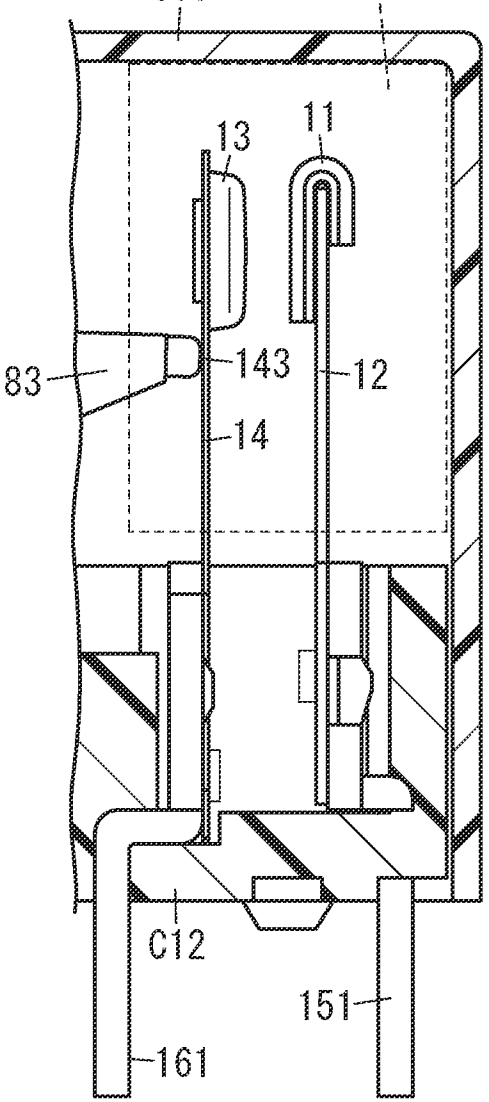
FIG. 3B is a cross-sectional view illustrating an OFF state of the contact device in that part of the electromagnetic relay.
Figure 3A:
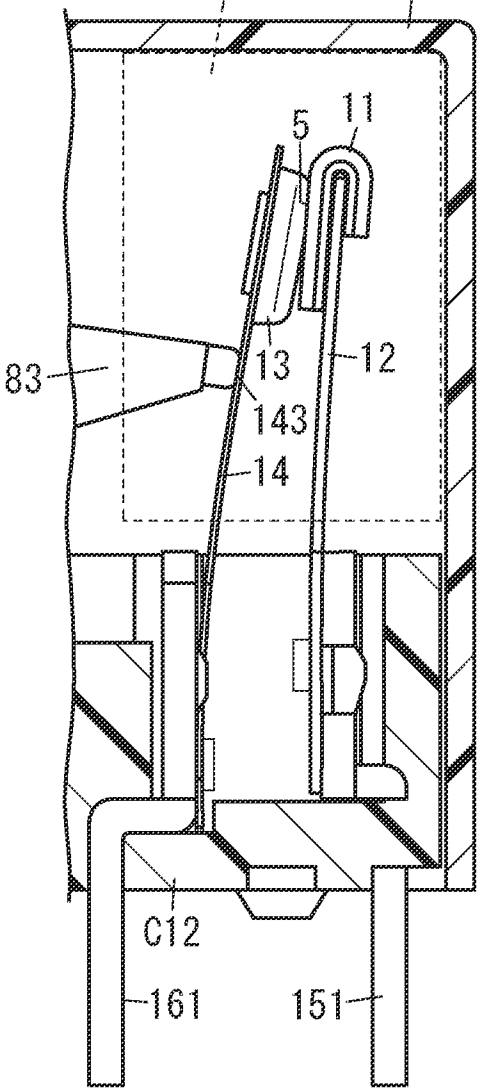
FIG. 3A is a cross-sectional view illustrating an ON state of a contact device in a part of the electromagnetic relay.

The moving contact 13 moves back and forth between a closed position where the moving contact 13 comes into contact with the fixed contact 11 and an open position where the moving contact 13 goes out of contact with the fixed contact 11 (see FIGS. 3A and 3B). The moving contact holder 14 is provided with the moving contact 13 at one end portion 141 thereof in one direction (e.g., the upward direction in this example) (hereinafter simply referred to as an "upper end portion"). The fixed contact holder 12 is provided with the fixed contact 11 at an upper end portion 121 thereof. The moving contact holder 14 is elastically deformed about an end portion 142 thereof in the downward direction (hereinafter simply referred to as a "lower end portion") as a fulcrum, thereby allowing the moving contact 13 to move back and forth between a closed position and an open position. When the moving contact 13 is located at the open position, the gap distance (contact gap) between the fixed contact 11 and the moving contact 13 may be in the range from 0.5 mm to 1.0 mm, for example. Note that this numerical value is only an example and should not be construed as limiting.

When the coil 20 is energized, electromagnetic force is generated between the armature 60 and an iron core 40 (to be described later) and between the armature 60 and a yoke 50 (to be described later). This electromagnetic force causes the armature 60 to be displaced. The card 80 is provided between the armature 60 and the moving contact holder 14, and displaces the moving contact holder 14 as the armature 60 is displaced.

The first terminal plate 15 and the lower end portion 122 of the fixed contact holder 12 are electrically connected together by fitting a first projection (dowel), provided for the first terminal plate 15, into a hole cut through the fixed contact holder 12 and caulking and fixing the first terminal plate 15 and the fixed contact holder 12 together. The first terminal plate 15 is electrically connected to a negative electrode of a DC power supply 2 (hereinafter simply referred to as a "power supply 2").

The second terminal plate 16 and the lower end portion 142 of the moving contact holder 14 are electrically connected together by fitting a second projection (dowel), provided for the second terminal plate 16, into a hole cut through the moving contact holder 14 and caulking and fixing the second terminal plate 16 and the moving contact holder 14 together. The second terminal plate 16 is electrically connected to a positive electrode of the DC power supply 2.

The electromagnetic relay 1 according to this embodiment will be described in detail.

Figure 5:
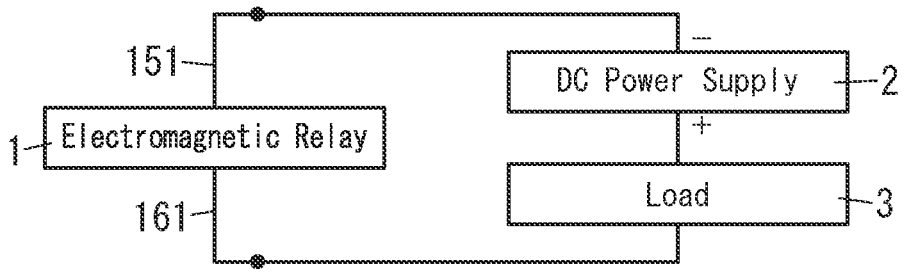
FIG. 5 illustrates an exemplary connection scheme for the electromagnetic relay.

The electromagnetic relay 1 according to this embodiment is used as a device for cutting off a DC current of 1 to 30 A with a DC voltage of 250 to 1000 V. Note that these numerical values are only examples and should not be construed as limiting. In this embodiment, the electromagnetic relay 1 is supposed to be used, for example, such that a contact device A1 (to be described later) is inserted and connected to a path along which DC power is supplied from the power supply 2 to a load 3 (such as an inverter circuit or a DC-DC converter circuit) as shown in FIG. 5. This allows the electromagnetic relay 1 according to this embodiment to supply, or cut off the supply of, DC power from the power supply 2 to the load 3 by opening and closing (i.e., by turning ON and OFF) the contact device A1.

The power supply 2 may be, for example, a device that generates voltage, examples of which include a power generator (such as a solar cell) or a storage battery (such as a lithium ion battery).

As used herein, if one of a first terminal portion 151 (with the first terminal plate 15) or a second terminal portion 161 (with the second terminal plate 16) has the higher voltage than the other when the DC power is supplied from the power supply 2 to the electromagnetic relay 1, then the one terminal portion is supposed to be electrically connected to the positive electrode of the power supply 2 and the other terminal portion is supposed to be electrically connected to the negative electrode of the power supply 2.

The electromagnetic relay 1 according to this embodiment is implemented as a double coil latching relay, which is a type of hinged relay. The electromagnetic relay 1 according to this embodiment includes the contact device A1, an electromagnetic device A10, a case C1, and the card 80 as shown in FIGS. 1 and 4.

<Description of Contact Device A1>

The contact device A1 includes the fixed contact holder 12 provided with the fixed contact 11, the moving contact holder 14 provided with the moving contact 13, the first terminal plate 15, the second terminal plate 16, and magnets 17, 18 as shown in FIG. 4. In FIG. 1, illustration of the magnet 18 is omitted.

The first terminal plate 15 and the second terminal plate 16 are made of an electrically conductive material (such as a copper alloy) and have the shape of a flat plate, of which the thickness is defined by the rightward/leftward direction (corresponding to the second axis direction).

The flat plate portion of the first terminal plate 15 has its length defined in the third axis direction and is provided with first projections, which are raised along the thickness thereof (i.e., in the rightward/leftward direction). Two projections are arranged as the first projections along its length (in the third axis direction). The fixed contact holder 12 is fixed onto the first terminal plate 15 by fitting the pair of first projections into first fixing holes cut through the fixed contact holder 12 and caulking the fixed contact holder 12 and the first terminal plate 15 together.

The flat plate portion of the second terminal plate 16 has its length defined in the third axis direction and is provided with second projections, which are raised along the thickness thereof (i.e., in the rightward/leftward direction). Two projections are arranged as the second projections along its length (in the third axis direction). The moving contact holder 14 is fixed onto the second terminal plate 16 by fitting the pair of second projections into second fixing holes cut through the moving contact holder 14 and caulking the moving contact holder 14 and the second terminal plate 16 together.

The first terminal plate 15 includes a first terminal portion 151, and the second terminal plate 16 includes a second terminal portion 161. The first terminal portion 151 protrudes downward from the lower end portion of the first terminal plate 15. The second terminal portion 161 protrudes downward from the lower end portion of the second terminal plate 16. The first terminal portion 151 is electrically connected to an electrical path connected to the power supply 2. The second terminal portion 161 is electrically connected to an electrical path connected to the load 3. Specifically, the first terminal portion 151 is electrically connected to the negative electrode of the power supply 2, and the second terminal portion 161 is electrically connected to the positive electrode of the power supply 2 via the load 3 (see FIG. 5).

The fixed contact holder 12 is made of an electrically conductive material. The fixed contact holder 12 may be formed in a T-plate shape. The fixed contact holder 12 is formed such that an end portion 122 thereof has a greater dimension as measured in the third axis direction than an end portion 121 thereof. The end portion 121 is formed so as to be linearly extended upward from a middle in the third axis direction of the end portion 122 (see FIG. 6C). In this embodiment, the fixed contact holder 12 has its end portion 122 fixed onto the first terminal plate 15 so as to be extended in a predetermined direction (e.g., upward in this embodiment) from the first terminal plate 15. Bonding a plate-like tape contact 200 onto the end portion 121 of the fixed contact holder 12 allows the fixed contact 11 to be provided. It will be described later how to bond the fixed contact 11 to the fixed contact holder 12.

The end portion 122 (lower end portion) of the fixed contact holder 12 has a pair of first fixing holes running through the thickness thereof (i.e., in the rightward/leftward direction). The end portion 122 of the fixed contact holder 12 is fixed onto the first terminal plate 15. Specifically, the fixed contact holder 12 is fixed onto the first terminal plate 15 by fitting the pair of first projections of the first terminal plate 15 into the pair of first fixing holes of the fixed contact holder 12 and caulking the first terminal plate 15 and the fixed contact holder 12 together (see, for example, FIG. 1, in which illustration of the first fixing holes is omitted).

The moving contact holder 14 is made of an electrically conductive material. The moving contact holder 14 may be formed in a T-plate shape. The moving contact holder 14 is formed such that an end portion 142 thereof has a greater dimension as measured in the third axis direction than an end portion 141 thereof. The end portion 141 is formed so as to be linearly extended upward from a middle in the third axis direction of the end portion 142. In this embodiment, the moving contact holder 14 has its end portion 142 fixed onto the second terminal plate 16 so as to be extended in a predetermined direction (e.g., upward in this embodiment) from the second terminal plate 16. The end portion 141 of the moving contact holder 14 has an mounting hole to which the moving contact 13 is attached. The moving contact 13 has a disk shape when viewed along the thickness thereof (i.e., the rightward/leftward direction). The moving contact 13 is formed in a shape with a diameter decreasing as the distance to the fixed contact decreases. The other surface, opposite from one surface in contact with the fixed contact 11, of the moving contact 13 (i.e., the back surface of the moving contact 13) is provided with a protruding shaft. The shaft of the moving contact 13 is inserted into the mounting hole of the moving contact holder 14. The moving contact 13 is fixed onto the moving contact holder 14 by caulking the shaft and the moving contact holder 14 together.

The end portion 142 (lower end portion) of the moving contact holder 14 has a pair of second fixing holes running through the thickness thereof (i.e., in the rightward/leftward direction). The end portion 142 of the moving contact holder 14 is fixed onto the second terminal plate 16. Specifically, the moving contact holder 14 is fixed onto the second terminal plate 16 by fitting the pair of second projections of the second terminal plate 16 into the pair of second fixing holes of the moving contact holder 14 and caulking the second terminal plate 16 and the moving contact holder 14 together (see, for example, FIG. 1, in which illustration of the second fixing holes is omitted).

The moving contact holder 14 and the fixed contact holder 12 are arranged to face each other with a gap left between themselves in the rightward/leftward direction. Therefore, the moving contact 13 of the moving contact holder 14 faces the fixed contact 11 of the fixed contact holder 12 in the rightward/leftward direction.

As the electromagnetic device A10 operates, the moving contact holder 14 is elastically deformed about the end portion 142 (lower end portion) thereof, opposite from the end portion 141 (upper end portion) thereof, as a fulcrum. At this time, the end portion 141 (that is a free end) of the moving contact holder 14 is displaced in the rightward/leftward direction to move the moving contact 13 back and forth between the closed position and the open position. As used herein, the "closed position" refers to a position where the moving contact 13 comes into contact with the fixed contact 11 (see FIG. 3A). On the other hand, the open position is a position where the moving contact 13 goes out of contact with the fixed contact 11 (see FIG. 3B).

When the moving contact 13 is in the closed position (i.e., when the contact device A1 is ON), the first terminal plate 15 and the second terminal plate 16 are short-circuited with each other via the moving contact holder 14 and the fixed contact holder 12. Therefore, when the contact device A1 is ON, the first terminal plate 15 and the second terminal plate 16 are electrically conductive with each other, and therefore, DC power is supplied from the power supply 2 to the load 3. On the other hand, when the moving contact 13 is in the open position (i.e., when the contact device A1 is OFF), the first terminal plate 15 and the second terminal plate 16 are electrically disconnected from each other, and therefore, no DC power is supplied from the power supply 2 to the load 3.

In this embodiment, the thickness (i.e., the dimension as measured in the rightward/leftward direction) of the moving contact holder 14 is set at a value small enough to allow the moving contact holder 14 to be elastically deformed about the end portion 142 thereof as a fulcrum. The moving contact holder 14 may have a thickness of 80 μm to 150 μm, for example. Note that this numerical value is only an example and should not be construed as limiting.

In this embodiment, the thickness (i.e., the dimension as measured in the rightward/leftward direction) of the first terminal plate 15 is greater than the thickness of fixed contact holder 12, and the thickness (i.e., the dimension as measured in the rightward/leftward direction) of the second terminal plate 16 is greater than the thickness of moving contact holder 14. Also, the thickness of the fixed contact holder 12 is greater than the thickness of the moving contact holder 14. Making the first terminal plate 15 and the second terminal plate 16 thicker than the fixed contact holder 12 and the moving contact holder 14, respectively, allows these portions to have decreased electrical resistance and increased current carrying capacity. In addition, making the fixed contact holder 12 thicker than the moving contact holder 14 allows this portion to have decreased electrical resistance and increased current carrying capacity.

As described above, the fixed contact holder 12 is formed in a T-shape, of which the end portion 122 has a greater dimension as measured in the third axis direction than the end portion 121 thereof. This increases the area of contact between the fixed contact holder 12 and the first terminal plate 15, thus decreasing the electrical resistance in the contact portion and increasing the current carrying capacity. In addition, increasing the dimension as measured in the third axis direction of the end portion 122 allows the interval between the pair of first fixing holes to be widened, thus increasing the degree of stability when the fixed contact holder 12 is fixed onto the first terminal plate 15.

As also described above, the moving contact holder 14 is formed in a T-shape, of which the end portion 142 has a greater dimension as measured in the third axis direction than the end portion 141 thereof. This increases the area of contact between the moving contact holder 14 and the second terminal plate 16, thus decreasing the electrical resistance in the contact portion and increasing the current carrying capacity. In addition, increasing the dimension as measured in the third axis direction of the end portion 142 allows the interval between the pair of second fixing holes to be widened, thus increasing the degree of stability when the moving contact holder 14 is fixed onto the second terminal plate 16.

The magnets 17 and 18 are permanent magnets. The magnets 17 and 18 are arranged in a direction perpendicular to a line connecting the closed position and open position of the fixed contact 11 and the moving contact 13 (i.e., the opening/closing direction). Specifically, the magnets 17 and 18 are arranged to face each other with the moving contact holder 14 and the fixed contact holder 12 interposed between themselves in the third axis direction such that upward Lorentz force F1 (in a predetermined direction) acts on an arc generated between the fixed contact 11 and the moving contact 13. More specifically, the magnets 17 and 18 are arranged such that one surface 17*a*, facing the magnet 18, out of the two surfaces in the third axis direction of the magnet 17 has a different polarity from one surface 18*a*, facing the magnet 17, out of the two surfaces in the third axis direction of the magnet 18. In this embodiment, the fixed contact 11 is electrically connected to the negative electrode of the DC power supply 2 in the electric circuit shown in FIG. 5 and the moving contact 13 is electrically connected to the positive electrode of the power supply 2. The surface 17*a* of the magnet 17 has S pole, while the surface 18*a*, facing the surface 17*a* of the magnet 17, of the other magnet 18 has N pole. The magnetic flux density B1 indicates the density of magnetic flux generated by the magnets 17 and 18. If an arc current I1 generated between the fixed contact 11 and the moving contact 13 flows from the moving contact 13 toward the fixed contact 11, then the Lorentz force F1 acting on the current I1 comes to have an upward direction (i.e., the predetermined direction) (see FIG. 2B).

Note that the polarities of the magnets 17 and 18 are determined such that in the space between the moving contact 13 and the fixed contact 11, the direction of the exterior product F1×I1 of the vector of the Lorentz force F1 and the vector of the current I1 agrees with the orientation of the magnetic flux density B1. That is to say, the surface 17*a* of the magnet 17 is provided with S pole and the surface 18*a* of the magnet 18 is provided with N pole such that if the fixed contact 11 is the negative electrode side of the power supply 2 and the moving contact 13 is the positive electrode side thereof, then the Lorentz force F1 is applied upward. Also, in other words, the polarities of the magnets 17 and 18 are determined such that supposing Vector A indicates the predetermined direction (upward direction) and Vector B indicates a direction pointing from the contact connected to the positive electrode side toward the contact connected to the negative electrode side, the orientation of the magnetic flux between the contacts agrees with the direction of A×B, where A×B indicates the exterior product of Vectors A and B.

Also, as shown in FIGS. 1, 3A, and 3B, the respective members are arranged such that when the magnet 17 is viewed from the magnet 18 (i.e., in the third axis direction), the fixed contact 11, the moving contact 13, the end portion 121 of the fixed contact holder 12, and the end portion 141 of the moving contact holder 14 overlap with the surface 17*a* of the magnet 17. In addition, the respective members are arranged such that when the magnet 17 is viewed from the magnet 18 (i.e., in the third axis direction), the surface 18*a* of the magnet 18 is aligned with the surface 17*a* of the magnet 17.

<Description of Electromagnetic Device A10>

Figure 2B:
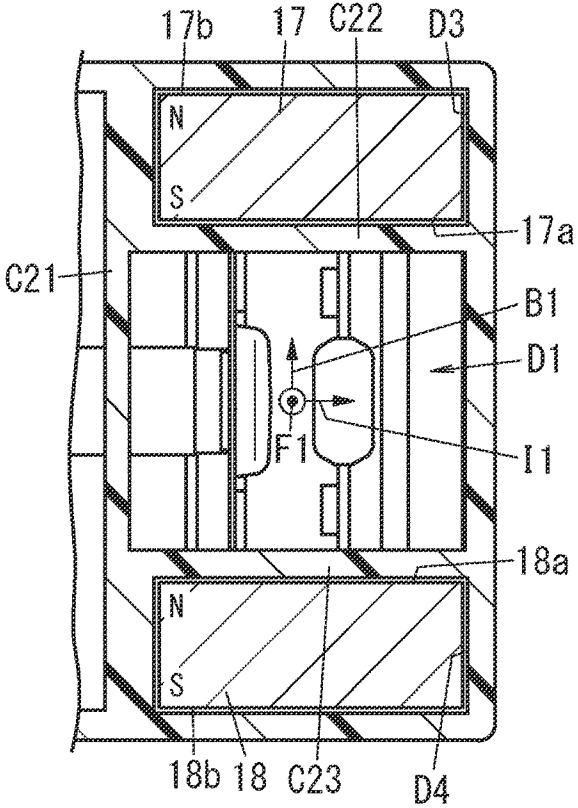
FIG. 2B is a cross-sectional view of a part of the electromagnetic relay when the part is viewed in plan.
Figure 2A:
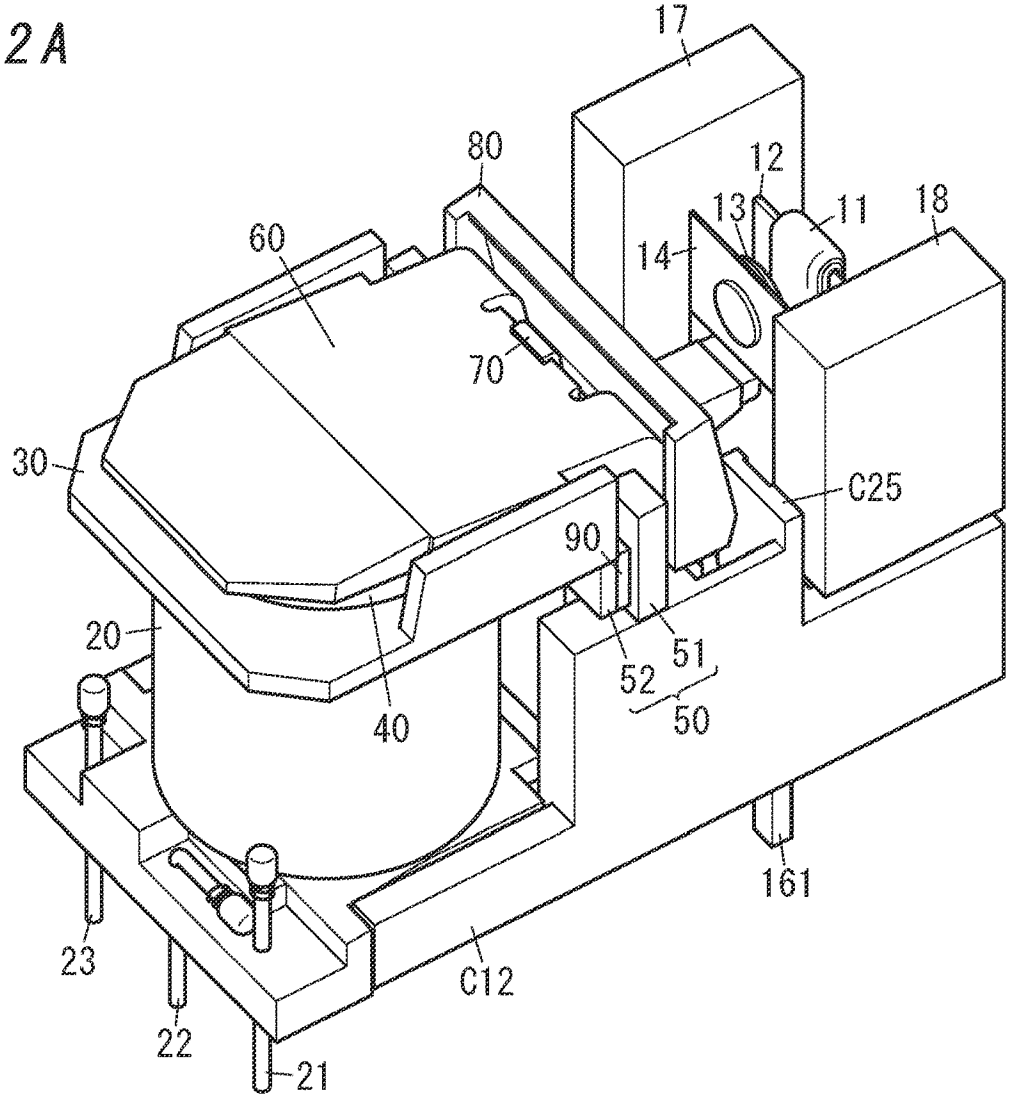
FIG. 2A is a perspective view of the electromagnetic relay.

As shown in FIGS. 1 and 2A, the electromagnetic device A10 includes the coil 20, a bobbin 30, an iron core 40, a yoke 50, the armature 60, a hinge spring 70, and a magnet 90. The iron core 40, the yoke 50, and the armature 60 are all made of a magnetic material (such as electromagnetic soft iron). FIG. 2A is a perspective view of the electromagnetic relay 1 from which a cover C11 (to be described later) is removed.

The coil 20 is formed by winding an electric wire (such as a copper wire) around an outer peripheral surface of the bobbin 30. The coil 20 consists of a first winding formed by winding the electric wire clockwise around the outer peripheral surface of the bobbin 30 when viewed from over the coil 20 and a second winding formed by winding the electric wire counterclockwise around the outer peripheral surface of the bobbin 30 when viewed from over the coil 20. The coil 20 further includes three coil terminals 21, 22, and 23 as shown in FIG. 2A. One end of the first winding is electrically connected to the coil terminal 21, and the other end thereof is electrically connected to the coil terminal 22. One end of the second winding is electrically connected to the coil terminal 23, and the other end thereof is electrically connected to the coil terminal 22.

Applying voltage between the coil terminals 21 and 22 with the voltage at the coil terminal 22 set at the lower potential (of 0 volts, for example) causes the coil 20 to supply a current to the first winding via the coil terminals 21 and 22, thus generating a downward magnetic flux. Also, applying voltage between the coil terminals 23 and 22 with the voltage at the coil terminal 22 set at the lower potential (of 0 volts, for example) causes the coil 20 to supply a current to the second winding via the coil terminals 23 and 22, thus generating an upward magnetic flux.

The bobbin 30 is made of a material with electrical insulation properties such as a synthetic resin material and formed in a cylindrical shape. The bobbin 30 is arranged such that its axis is aligned with the upward/downward direction.

The iron core 40 is formed in the shape of a column elongated in the upward/downward direction. The iron core 40 is inserted into a hollow portion 31 of the bobbin 30 with both longitudinal ends (i.e., both ends in the upward/downward direction) thereof exposed out of the bobbin 30. A first longitudinal end portion (i.e., an upper end portion) of the iron core 40 has a larger diameter than a middle portion thereof, and faces the armature 60. In the following description, the first end portion of the iron core 40 will be hereinafter referred to as an "iron core attracting portion 41." On the other hand, a second longitudinal end portion (lower end portion) of the iron core 40 is inserted into an insertion hole 55 cut through a first plate 53 (to be described later) of the yoke 50.

The yoke 50 consists of a first yoke 51 and a second yoke 52. The yoke 50 forms, along with the iron core 40, the armature 60, and the magnet 90, a magnetic path for the magnetic flux, generated when the coil 20 is energized, to pass through. The first yoke 51 is formed to have an L-cross section by having a middle portion of a rectangular plate, elongated in the upward/downward direction, folded to the left. The first yoke 51 includes a first plate 53 and a second plate 54. Each of the first plate 53 and second plate 54 is formed in a rectangular plate shape. The first plate 53 is provided for one end (i.e., the lower end) along the axis (upward/downward direction) of the coil 20. The first plate 53 has the insertion hole 55 running through the thickness thereof (in the upward/downward direction). The second end portion of the iron core 40 is inserted into the insertion hole 55 and caulked thereto. The second plate 54 is provided on the right of the coil 20. The second yoke 52 is provided between the coil 20 and the second plate 54 of the first yoke 51.

The armature 60 is formed to have an L-cross section by having a middle portion 63 of a rectangular plate, elongated in the rightward/leftward direction, folded downward. An inner corner 64 of the folded portion at the middle 63 of the armature 60 is in contact with an upper right corner 56 of the first yoke 51 (see FIG. 1). The armature 60 includes a first plate 61 and a second plate 62. Each of the first plate 61 and the second plate 62 is formed in the shape of a rectangular plate. The tip of the first plate 61 of the armature 60 abuts on the card 80 as shown in FIG. 1 (see FIG. 8B as well). The first plate 61 faces a yoke attracting portion 57, which forms part of the first yoke 51, with a lower portion 71 of the hinge spring 70 interposed between themselves. That is to say, the lower portion 71 of the hinge spring 70 is arranged between the first plate 61 and the yoke attracting portion 57. The second plate 62 faces the iron core attracting portion 41 that forms part of the iron core 40.

The armature 60 is configured to turn, around the inner corner 64 of its folded portion as a fulcrum, between a first position where the second plate 62 is in contact with the iron core attracting portion 41 of the iron core 40 and a second position where the second plate 62 is out of contact with the iron core attracting portion 41 of the iron core 40. The second plate 62 of the armature 60 is attracted toward, or released from, the iron core attracting portion 41 of the iron core 40 by the electromagnetic force generated when the coil 20 is energized. When the armature 60 is at the first position, the first plate 61 is out of contact with the lower portion 71 of the hinge spring 70. Also, when the armature 60 is at the first position, the first plate 61 of the armature 60 is displaced to the right. The card 80 is displaced along with the armature 60, thus elastically deforming the moving contact holder 14 to the right via the card 80. On the other hand, when the armature 60 is at the second position, the first plate 61 is in contact with the lower portion 71 of the hinge spring 70. Also, when the armature 60 is at the second position, the first plate 61 of the armature 60 moves to the left, thus making the moving contact holder 14 upright when viewed in the third axis direction as shown in FIG. 3B.

The hinge spring 70 is formed to have an L-cross section by having an upper tip thereof folded to the left. The hinge spring 70 and the yoke 50 hold the armature 60 so as to allow the armature 60 to turn, around the inner corner 64 of the folded portion of the armature 60 as a fulcrum, between the first position and the second position. The inner corner 64 of the folded portion of the armature 60 is in contact with the upper right corner 56 of the first yoke 51 (see FIG. 1).

The magnet 90 is sandwiched between the first yoke 51 and the second yoke 52. The surface facing the second yoke 52 (i.e., the left surface) of the magnet 90 has S pole and the surface facing the first yoke 51 (i.e., the right surface) of the magnet 90 has N pole. The magnet 90 generates magnetic flux inside the yoke 50, the armature 60, and the iron core 40, between the first plate 61 of the armature 60 and the yoke attracting portion 57 of the yoke 50, and between the second plate 62 of the armature 60 and the iron core attracting portion 41 of the iron core 40. The magnetic flux generated by the magnet 90 between the first plate 61 and the yoke attracting portion 57 is oriented from the first plate 61 toward the yoke attracting portion 57 (i.e., leftward). The magnetic flux generated by the magnet 90 between the second plate 62 and the iron core attracting portion 41 is oriented from the second plate 62 toward the iron core attracting portion 41 (i.e., downward). These magnetic fluxes work to generate electromagnetic forces (magnetic attraction) between the first plate 61 and the yoke attracting portion 57 and between the second plate 62 and the iron core attracting portion 41. These electromagnetic forces keep the contact device A1 ON or OFF even if no current is flowing through the coil 20, thus realizing a latching relay.

<Description of Card 80>

The card 80 is provided between the armature 60 and the moving contact holder 14 to displace the moving contact holder 14 as the armature 60 is displaced. The card 80 may be made of an electrically insulating synthetic resin, for example. The card 80 includes, in the middle, a first contact portion 83 protruding rightward toward the moving contact holder 14 and a second contact portion 84 protruding leftward toward the armature 60. The tip of the first contact portion 83 is in contact with a holder contact portion 143 which forms part of the moving contact holder 14. The second contact portion 84 is in contact with the first plate 61 of the armature 60. The card 80 is rotatable around a lower end portion 82 thereof as a fulcrum as the armature 60 turns between the first position and the second position.

In this embodiment, as the armature 60 turns from the second position to the first position, the card 80 rotates clockwise around the end portion 82 as a fulcrum. This rotation causes the first contact portion 83 to move to the right, thus moving the holder contact portion 143 of the moving contact holder 14 to the right as well. As a result, the moving contact holder 14 is elastically deformed to the right as shown in FIG. 3A, thus bringing the moving contact 13 into contact with the fixed contact 11.

On the other hand, as the armature 60 turns from the first position to the second position, the card 80 rotates counterclockwise around the end portion 82 as a fulcrum. This rotation causes the first contact portion 83 to move to the left, thus moving the holder contact portion 143 of the moving contact holder 14 to the left as well. As a result, the moving contact holder 14 turns upright and straight as shown in FIG. 3B, thus bringing the moving contact 13 out of contact with the fixed contact 11.

<Description of Case C1>

The case C1 may be made of a material with electrical insulation properties such as a synthetic resin. The case C1 may be formed by bonding a cover C11 and a base C12 with a thermosetting resin adhesive, for example. The case C1 houses the contact device A1, the electromagnetic device A10 and the card 80. As shown in FIG. 1, the first terminal portion 151 of the first terminal plate 15 and the second terminal portion 161 of the second terminal plate 16 of the contact device A1 are exposed out of the lower surface of the base C12. In addition, as shown in FIG. 1, respective parts of the coil terminals 21, 22, and 23 of the electromagnetic device A10 are exposed out of the lower surface of the bobbin 30.

The cover C11 has inner walls C21-C23 (see FIG. 2B). The base C12 also has an inner wall C25 (see FIGS. 1 and 2A). In FIG. 1, illustration of the inner walls C22 and C23 is omitted. An insertion hole C24 is provided between the inner walls C21 and C25. The first contact portion 83 of the card 80 is inserted into the insertion hole C24 (see FIGS. 8A, 8C, and 8D). Thus, the rotation of the card 80 allows the first contact portion 83 to move in the rightward/leftward direction.

Joining the cover C11 and the base C12 together makes the inner walls C21-C23 and C25 and the cover C11 form spaces D1 and D2. The space D1 is a space for housing the fixed contact 11, the fixed contact holder 12, the moving contact 13, and the moving contact holder 14. The space D2 is a space for housing the electromagnetic device A10. These spaces D1 and D2 are defined by being partitioned by the inner walls C21 and C25. In addition, another space D3 for housing the magnet 17 is formed by the outer wall of the cover C11 and the inner walls C21 and C22, and still another space D4 for housing the magnet 18 is formed by the outer wall of the cover C11 and the inner walls C21 and C23.

A stretch space E1 in the space D1 is a space in which an arc is stretched. The stretch space E1 includes a space between the fixed contact 11 and the moving contact 13 moving back and forth between the closed position and the open position. The stretch space E1 further includes a space in contact with the other surface 12*b*, opposite from the surface 12*a* on which the fixed contact 11 and the moving contact 13 come into contact with each other, out of the two surfaces 12*a* and 12*b* along the thickness (rightward/leftward direction) of the fixed contact holder 12. The stretch space E1 further includes a space in contact with the other surface 14*b*, opposite from the surface 14*a* on which the fixed contact 11 and the moving contact 13 come into contact with each other, out of the two surfaces 14*a* and 14*b* along the thickness (rightward/leftward direction) of the moving contact holder 14. The stretch space E1 further includes a space beyond the respective tips of the fixed contact holder 12 and moving contact holder 14 in the upward/downward direction. In the stretch space E1, the lower end of the space facing the surface 14*b* is defined by the first contact portion 83 protruding rightward from the middle of the card 80. In the stretch space E1, the lower end of the space facing the surface 12*b* is defined by the base C12. Providing these spaces allows the arc, stretched by the action of the Lorentz force F1, to reach the surface 12*b* of the fixed contact holder 12 and the surface 14*b* of the moving contact holder 14. The arc that has reached the surface 12*b* of the fixed contact holder 12 and the surface 14*b* of the moving contact holder 14 may be extended (or stretched) through the lower end of the stretch space E1. That is to say, the stretch space E1 in which the arc is stretched by the action of the Lorentz force F1 is provided to face the surface 12*b* of the fixed contact holder 12 and the surface 14*b* of the moving contact holder 14. This ensures a distance long enough to extend the arc, thus improving the cutoff ability. Note that if the current or voltage to cut off is insignificant, the arc could be cut off before reaching the lower end of the stretch space E1. Even in such a situation, the broad stretch space E1 reduces the effect of the wall portions, defining the stretch space E1, interfering with a gas flow when the arc is being stretched. This allows the arc to be cut off effectively with good stability.

<Description of Tape Contact 200>

Next, the process step of bonding a tape contact 200 onto the fixed contact holder 12 to form the fixed contact 11 will be described with reference to FIGS. 6A-6D.

The tape contact 200 consists of three layers, namely. a first layer 201, a second layer 202, and a third layer 203. The first layer 201 is the uppermost layer, and made of a silver alloy. The second layer 202 is an intermediate layer, and is made of a copper alloy. The third layer 203 is a lowermost layer and is made of a brazing material. The thickness of the first layer 201 is almost equal to the thickness of the second layer 202, and may fall within the range from 200 μm to 300 μm, for example. The third layer 203 is much thinner than any of the other layers, and may be about one-twentieth as thick as the first layer 201. Note that these numerical values are only examples and should not be construed as limiting.

Figure 6A:
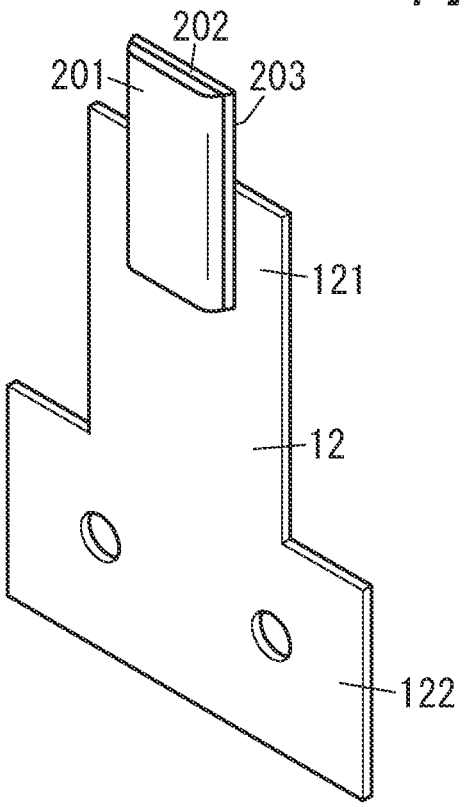
FIGS. 6A-6D illustrate respective process steps to form a fixed contact.
Figure 6B:
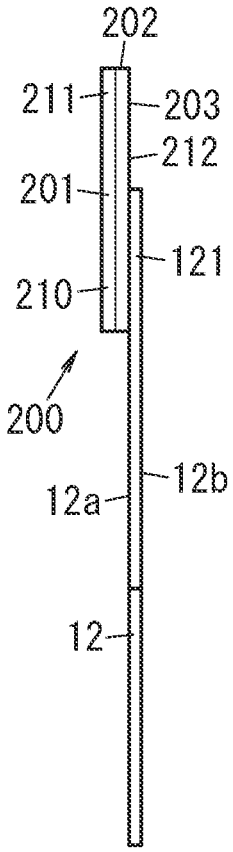
Figure 6C:
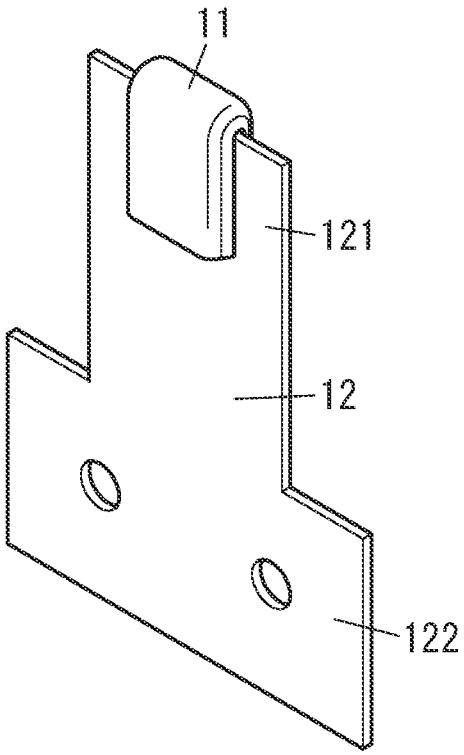
Figure 6D:
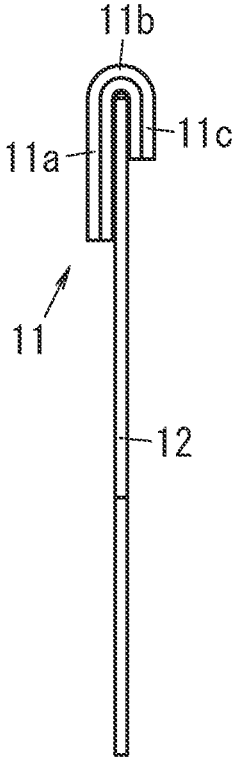
Figure 7:
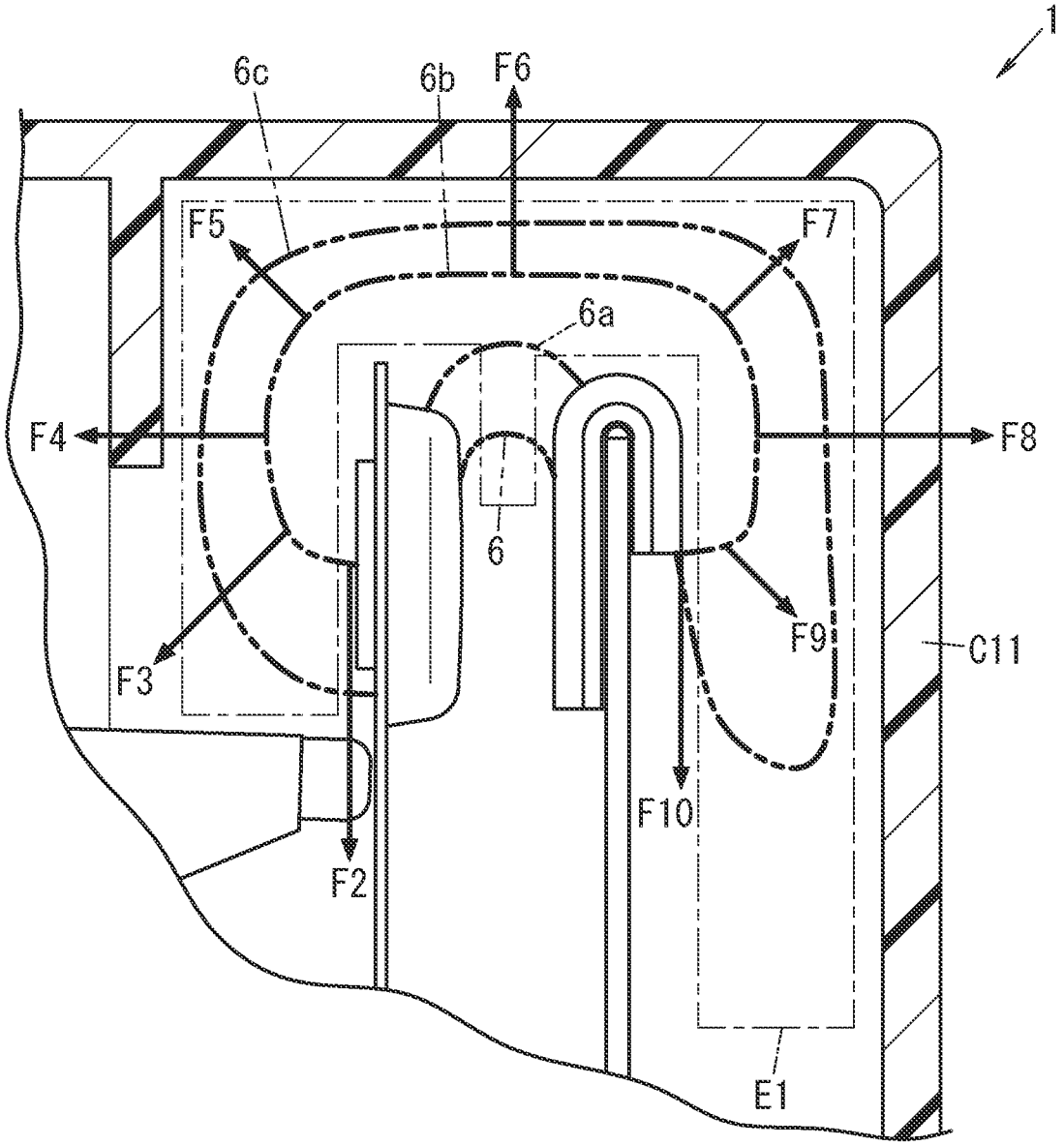
FIG. 7 shows a part of the electromagnetic relay to illustrate Lorentz force acting on an arc.
Figure 8C:
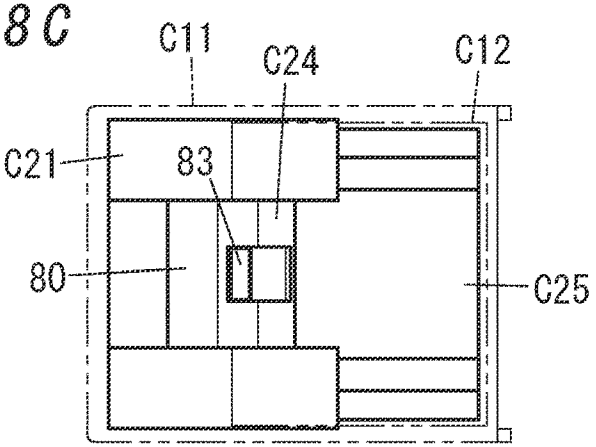
FIG. 8C is a side view of the assembly structure as viewed from the right.
Figure 8D:
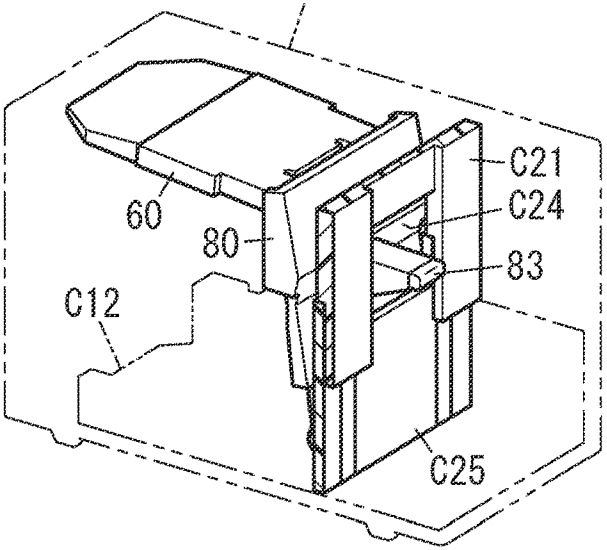
FIG. 8D is a perspective view of the assembly structure.
Figure 8A:
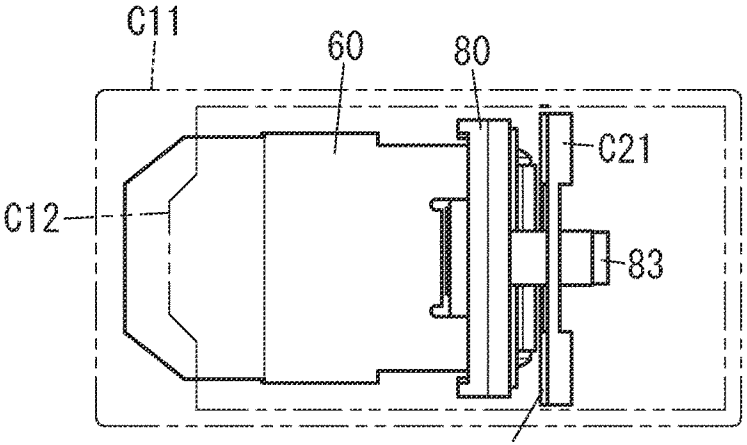
FIG. 8A is a plan view illustrating the assembly structure of an armature, a card, and an inner wall in a part of the electromagnetic relay.
Figure 8B:
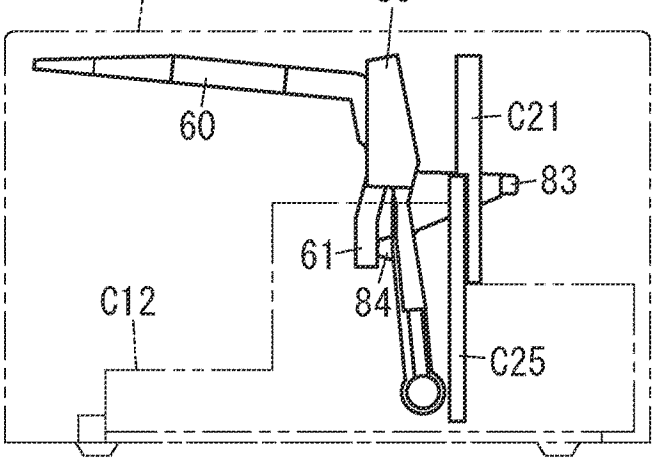
FIG. 8B is a front view of the assembly structure as viewed in a third axis direction.

The third layer 203 of a portion 210, including one of two end portions, of the tape contact 200 is laid on the surface 12*a* at the end portion 121 of the fixed contact holder 12. Then, heat applied thereto causes the brazing material of the third layer 203 to be melted, thus bonding the portion 210, including one end portion of the tape contact 200, onto the surface 12*a* of the fixed contact holder 12 (see FIGS. 6A and 6B). Then, the tape contact 200 is bent about the portion 212 of the tape contact 200, which is in contact with the tip of the fixed contact holder 12, as a fulcrum to bring the third layer 203 of the portion 211 into contact with the surface 12*b* at the end portion 121 of the fixed contact holder 12 (see FIGS. 6C and 6D). As a result, the fixed contact 11 is formed. As shown in FIGS. 1 and 6D, the fixed contact 11 includes a first contact portion 11*a* bonded to the surface 12*a*, a curved portion 11*b* bent around the portion 212 as a fulcrum, and a second contact portion 11*c* in contact with the surface 12*b*. That is to say, in the fixed contact 11, the first contact portion 11*a* and the second contact portion 11*c* are continuous with each other via the curved portion 11*b*. In this case, when the contact device A1 is ON, the first contact portion 11*a* comes into contact with the moving contact 13.

A brazing material is used to bond the tape contact 200 to the fixed contact holder 12. The second layer 202 of the tape contact 200 and the surface 12*a* of the fixed contact holder 12 are bonded together so as to have their gap filled with the molten brazing material. This allows the second layer 202 of the tape contact 200 and the surface 12*a* of the fixed contact holder 12 to be bonded together in a broad planar area, thus increasing the bond strength. This prevents the tape contact 200 from being delaminated when the tape contact 200 is bent around the portion 212 as a fulcrum.

The fixed contact 11 is continuous from the first contact portion 11*a* (particularly, a region 5 in contact with the moving contact 13) through the upper end (tip) of the curved portion 11*b*, and therefore, has a smooth shape in the predetermined direction (i.e., upward direction in this embodiment). As used herein, to be "smooth in the predetermined direction" refers to a situation where a tangential line drawn with respect to the surface of the fixed contact 11 (the first contact portion 11*a*) has a continuously changing gradient from the contact region 5 through the tip of the curved portion 11. When the fixed contact 11 has such a smooth shape, the tangential line drawn with respect to a curve connecting the contact region 5 and the tip of the surface of the curved portion 11*b* has a continuously changing gradient on a cross section, covering the contact region 5 and perpendicular to the third axis direction, of the fixed contact 11.

Stated otherwise, if the fixed contact 11 is smooth in the predetermined direction, it means that at least the tip of the curved portion 11*b* has a curved cross section on a plane, taken in the upward/downward direction, of the first contact portion 11*a* and the curved portion 11*b*.

In a known electromagnetic relay, the fixed contact is caulked by, and fixed onto, its fixed contact holder. In such a structure, when an arc travels from one surface to the other of two surfaces along the thickness of the fixed contact holder, there are two members, namely, the fixed contact and the fixed contact holder, along its traveling path, and there is a gap between respective edges of the fixed contact and fixed contact holder. Therefore, the end point of the arc traveling could come to a halt at the gap between the edge of the fixed contact and the fixed contact holder.

In contrast, according to this embodiment, the fixed contact 11 is continuous, without a gap, from one surface 12*a* to the other surface 12*b* out of the two surfaces along the thickness of the fixed contact holder 12 via the curved portion 11*b*. This reduces the chances of the end point of the arc traveling coming to a halt. In addition, the fixed contact 11 has a smooth shape in the predetermined direction (i.e., the upward direction) from the first contact portion 11*a* through the upper end (tip) of the curved portion 11*b*, thus allowing the arc to move smoothly.

<Description of Operation of Electromagnetic Relay 1>

Next, it will be described with reference to FIGS. 3A and 3B how the electromagnetic relay 1 according to this embodiment operates. In the following description, the state of the moving contact holder 14 when the contact device A1 is OFF will be hereinafter referred to as an "original state."

Energizing the first winding of the coil 20 when the contact device A1 is in OFF state causes the coil 20 to generate a magnetic flux. In this case, the magnetic flux has a downward orientation, thus increasing the strength of the downward magnetic flux between the second plate 62 of the armature 60 and the iron core attracting portion 41 of the iron core 40. As a result, the second plate 62 and the iron core attracting portion 41 attract each other with strong magnetic attraction. This causes the armature 60 to turn counterclockwise to move from the second position to the first position. As the armature 60 moves to the first position, the first plate 61 of the armature 60 and the second contact portion 84 of the card 80 move to the right. At this time, the card 80 rotates clockwise around the lower end portion 82 thereof as a fulcrum. This causes the first contact portion 83 of the card 80 and the holder contact portion 143 of the moving contact holder 14 to move to the right as well. As a result, the moving contact holder 14 is elastically deformed to the right around the end portion 142 (lower end portion) as a fulcrum, thus moving the moving contact 13 to the closed position where the moving contact 13 comes into contact with the fixed contact 11 (see FIG. 3A). This turns the contact device A1 ON to make the first terminal plate 15 and the second terminal plate 16 ready to be electrically conductive with each other.

Providing the magnet 90 allows the contact device A1 to be kept ON by the magnetic force of the magnet 90 even when the first winding of the coil 20 is de-energized.

Next, energizing the second winding of the coil 20 when the contact device A1 is in ON state causes the coil 20 to generate a magnetic flux. In this case, the magnetic flux has an upward orientation, thus increasing the strength of the leftward magnetic flux between the first plate 61 of the armature 60 and the yoke attracting portion 57 of the iron yoke 50. As a result, the first plate 61 and the yoke attracting portion 57 attract each other with strong magnetic attraction. This causes the armature 60 to turn clockwise to move from the first position to the second position. As the armature 60 moves to the second position, the first plate 61 of the armature 60 and the second contact portion 84 of the card 80 move to the left. At this time, the card 80 rotates counterclockwise around the lower end portion 82 thereof as a fulcrum. This causes the first contact portion 83 of the card 80 and the holder contact portion 143 of the moving contact holder 14 to move to the left as well. As a result, the moving contact holder 14 makes a transition from the rightward elastically deformed state to the original state, thus moving the moving contact 13 to the open position where the moving contact 13 goes out of contact with the fixed contact 11 (see FIG. 3B). This turns the contact device A1 OFF to make the first terminal plate 15 and the second terminal plate 16 disconnected from each other and electrically unconductive with each other Note that the magnetic force of the magnet 90 keeps the contact device A1 OFF 90 even when the second winding of the coil 20 is de-energized.

<Description of Cutoff Ability and Electrical Durability>

When the contact device A1 turns from ON to OFF, an arc is generated between the fixed contact 11 and the moving contact 13 (i.e., at a contact region 5 shown in FIG. 3A). The contact device A1 according to this embodiment is able to cut off the arc by extending the length of the arc significantly. Thus, even when a high voltage is applied, or a large current flows, between the fixed contact 11 and the moving contact 13, the contact device A1 is still able to cut off the arc generated between the contacts to turn the contact device A1 from ON to OFF. That is to say, this improves the cutoff ability of the electromagnetic relay 1.

In this embodiment, the arc generated between the contacts moves upward from the region where the arc has been generated while being stretched upward by the action of the Lorentz force F1, as shown in FIG. 1. One end of the arc reaches the tip (upper end) of the curved portion 11*b*, and then moves toward the surface 12*b*. The other end of the arc reaches the tip (upper end) of the moving contact holder 14, and then moves toward the surface 14*b*. In this manner, the arc generated moves and turns from the arc 6 into the arcs 6*a*, 6*b*, and 6*c* in this order as shown in FIG. 1. When the arc turns into the arc 6*b* shown in FIG. 1, Lorentz force acts in the directions indicated by the arrows F2 to F10 in FIG. 7 on respective portions of the arc. As a result, the arc is further stretched even more significantly toward the walls surrounding the stretch space E1 to turn into the arc 6*c* shown in FIG. 1. As can be seen from the foregoing description, according to the method of this embodiment, the arc generated is stretched by moving through the broad stretch space E1, covering the region on the left of the moving contact holder 14 and the region on the right of the fixed contact holder 12, thus extending the arc length to the point of cutting off the arc easily.

People believe that an arc is generated by the thermal field emission of electrons from a cathode toward an anode. If there is a gap left between a contact and a holder that holds the contact while an end point of the arc is moving, the gap significantly increases the chances of stopping the movement of the end point of the arc. For example, if a contact is fixed onto its holder by caulking the contact and the holder together, a narrow gap is left between an edge of the contact and the holder. Thus, this gap significantly increases the chances of interfering with, and eventually stopping, the movement of the end point of the arc. Particularly when the gap is present at one end point, located closer to the cathode, of the arc (i.e., at the electron emission end), the gap is highly likely to bring the movement of the end point of the arc to a halt. The reason why the end point of the arc moving is highly likely to stop at the cathode-end gap should be because the gap decreases the conductivity of the heat. Specifically, if the end point of the cathode-end part of the arc is present on an edge of a contact, heat is not conducted easily to the contact holder adjacent to the edge, thus increasing the chances of the contact holder stopping thermal field emission newly. This significantly increases the chances of the end point of the cathode-end part of the arc stagnating at the edge of the contact without moving toward the contact holder. On the other hand, the other end, located closer to the anode, of the arc is the electron receiving end and is constantly moving, and therefore, there should be no need to conduct the heat to the region surrounding that end. Thus, at the other end of that anode-end part of the arc, even a gap left between an edge of a contact and its contact holder should be unlikely to stop the movement of the end point of the arc. If the arc stops moving on at least one of two ends of the arc, then the length of the arc cannot be extended sufficiently. Therefore, when a high voltage is applied, or a large current flows, between the contacts, the arc generated between the contacts cannot be cut off, thus making it impossible to turn the contact device from ON to OFF.

Furthermore, the stop of movement of the end point of the cathode-end part of the arc at an edge of a contact increases the chances of the arc shorting. As used herein, "shorting" of an arc refers to the phenomenon that an arc, which has had its length extended once, comes to have a shorter length again. When shorting of an arc occurs, it takes a longer time to cut off the arc, thus wearing the contacts more significantly and negatively impacting the electrical durability of the electromagnetic relay (i.e., the life of the contacts represented by the number of times of opening and closing of the contacts). The stop of movement of the end point of the cathode-end part of the arc at an edge of a contact should increase the chances of generating such arc shorting for the following reason. Specifically, if the end point of the cathode-end part of the arc stagnates at an edge of a contact, than a metal vapor, produced from the cathode of the arc in the vicinity of the contact, comes to have an increased concentration. A space with the metal vapor should allow the arc to conduct electricity more easily than a space without the metal vapor. For these reasons, when the arc stagnates at an end point closer to the cathode, the metal vapor comes to have an increased concentration in the vicinity of the contact, thus increasing the chances of the arc shorting between the contacts.

In contrast, according to this embodiment, the fixed contact 11 electrically connected to the negative electrode of the power supply 2 is a tape contact, which has a smooth shape from the contact region 5 in contact with the moving contact 13 through the tip (upper end) of the curved portion 11*b* in the direction of movement of the arc. That is to say, in the direction of movement of the arc (i.e., in the upward direction), there is no gap between the fixed contact 11 and the fixed contact holder 12. This reduces the chances of a cathode-end part of the arc stopping moving by the tip of the curved portion 11*b*. In addition, another part of the fixed contact 11, running from the tip of the curved portion 11*b* through the tip (lower end) of the second contact portion 11*c*, also has a smooth shape. This reduces the chances of a cathode-end part of the arc stopping moving in the range from the tip of the curved portion 11*b* through the tip of the second contact portion 11*c*. This allows the arc to be stretched in a space secured as the stretch space E1 for stretching the arc with the action of the Lorentz forces F1 and F2-F10, thus extending the arc length sufficiently. This allows the electromagnetic relay 1 to cut off the arc. Furthermore, according to this embodiment, the end point of the cathode-end part of the arc does not stop moving at any edge of the contact but is able to move quickly to the tip (lower end) of the second contact portion 11*c* through the tip of the curved portion 11*b*. Such movement is realized probably because the quick departure of the end point of the cathode-end part of the arc from the vicinity of the contact keeps the concentration of the metal vapor low in the vicinity of the contacts. Therefore, the electromagnetic relay 1 according to this embodiment is able to cut off the arc in a short time by reducing the frequency of occurrence of arc shorting, thus reducing the wear of the contacts and improving the electrical durability (i.e., the life of the contacts represented by the number of times of opening and closing the contacts) of the electromagnetic relay.

According to this embodiment, widening the contact gap makes the arc stretchable even more easily, thus improving the cutoff ability. Widening the contact gap increases the distance from the open position of the moving contact 13 to the closed position thereof, which requires increasing the angle of rotation of the armature 60. This in turn requires increasing the distance from the iron core attracting portion 41 of the iron core 40 to the second plate 62 of the armature 60. In that case, the attraction force required is greater than normal. Thus, the diameter of the iron core attracting portion 41 of the iron core 40 is increased to be approximately 2.5 times as large as the diameter of the iron core 40 inserted into the coil 20, for example. This allows attraction force generated to be greater than normal in a situation where there is a long distance between the iron core attracting portion 41 and the second plate 62. Consequently, even if the distance between the iron core attracting portion 41 of the iron core 40 and the second plate 62 of the armature 60 has increased, the contact device A1 is still able to be turned from OFF to ON with reliability.

Also, in general, when the ambient temperature of a relay (electromagnetic relay) rises, a phenomenon that the coil resistance increases so much as to cause a decrease in the amount of current flowing through the coil is often observed. In contrast, according to this embodiment, the attraction force between the iron core attracting portion 41 and the second plate 62 is greater than normal, thus allowing the contact device A1 to be turned from OFF to ON with reliability even when an increase in the ambient temperature of the electromagnetic relay 1 has caused a decrease in the amount of current flowing through the coil 20, for example. Thus, according to this embodiment, making the contact gap wider than normal improves the cutoff ability in turning the contact device A1 from ON to OFF, and increasing the diameter of the iron core attracting portion 41 increases the reliability of operation in turning the contact device A1 from OFF to ON.

<Description of Insulation Between Contact Device and Electromagnetic Device>

In this embodiment, the space D1 is surrounded with the inner walls C21-C23 and C25 and the case C1. In the space D1, housed are the fixed contact 11, the fixed contact holder 12, the moving contact 13, and the moving contact holder 14. The inner walls C21 and C25 define the spaces D2 in which the electromagnetic device A10 is housed and the space D1. The inner wall C21 faces the tip (upper end) of the moving contact holder 14. The inner wall C25 faces the end portion 142 of the moving contact holder 14. In addition, the space behind the moving contact holder 14 in the stretch space E1 is surrounded with the inner wall C21 and the first contact portion 83, protruding to the right, of the card 80. This prevents the arc being stretched from emitting from the stretch space E1 into the space D1. This reduces the chances of the contact device A1 and the electromagnetic device A10 being short-circuited with each other when an arc is generated between the fixed contact 11 and the moving contact 13. That is to say, this increases the degree of reliability of electrical insulation between the contact device A1 and the electromagnetic device A10.

The inner wall C21 is arranged between the moving contact holder 14 and the card 80. The card 80 is arranged between the moving contact holder 14 and the armature 60. The card 80 is also provided between the inner wall C21 and the armature 60. This prevents, even when abnormally high voltage is generated between the moving contact 13 and the armature 60, the arc from reaching the armature 60, thus ensuring electrical insulation between the contact device A1 and the electromagnetic device A10.

Also, the first plate 61 of the armature 60, located at the shortest distance from the contact device A1, is suitably included in any of the card 80, the inner wall C21, or the inner wall C25 when viewed in the second axis direction. This configuration increases the degree of reliability of electrical insulation between the contact device A1 and the electromagnetic device A10.

(Variations)

Next, variations will be enumerated one after another. Note that any of the variations to be described below may be combined as appropriate with the exemplary embodiment described above.

In the exemplary embodiment described above, the tape contact is applied to only the fixed contact 11. However, this is only an example and should not be construed as limiting. Alternatively, the tape contact is also applicable to only the moving contact 13 or both of the fixed contact 11 and the moving contact 13. That is to say, the tape contact may be applied to at least one of the fixed contact 11 or the moving contact 13. When the tape contact is applied to either the fixed contact 11 or the moving contact 13, the negative electrode of the power supply 2 is suitably electrically connected to the contact to which the tape contact is applied.

In the embodiment described above, the electromagnetic relay 1 includes the two magnets 17 and 18 to generate upward Lorentz force F1. However, this is only an example and should not be construed as limiting. The number of magnets that generate the upward Lorentz force F1 may be one. In that case, a magnetic body may be arranged to face the magnet and to interpose the fixed contact holder 12 and the moving contact holder 14 in the third axis direction. Then, the magnet and the magnetic body facing the magnet may be connected together via a part of the magnetic body or another magnetic body. This configuration allows a magnetic flux with a greater density to be generated in the vicinity of the contacts, compared to using a single magnet by itself. Thus, greater Lorentz force may be generated and cutoff of the arc may be promoted, compared to using a single magnet by itself. As the magnetic body, a piece of electromagnetic soft iron may be used, for example.

Also, in the embodiment described above, the length in the upward/downward direction of the magnet 17 may be defined such that when the magnet 17 is viewed in the third axis direction, the fixed contact 11, the moving contact 13, the end portion 121 of the fixed contact holder 12, and the end portion 141 of the moving contact holder 14 overlap with the surface 17*a* of the magnet 17. Likewise, the length in the upward/downward direction of the magnet 18 may also be defined such that when the magnet 18 is viewed in the third axis direction, the fixed contact 11, the moving contact 13, the end portion 121 of the fixed contact holder 12, and the end portion 141 of the moving contact holder 14 overlap with the surface 18*a* of the magnet 18.

In the embodiment described above, the fixed contact holder 12 and the first terminal plate 15 are formed separately from each other. However, this is only an example and should not be construed as limiting. Alternatively, the fixed contact holder 12 and the first terminal plate 15 may be formed integrally with each other. Likewise, the moving contact holder 14 and the second terminal plate 16 may also be formed integrally with each other.

Furthermore, in the embodiment described above, the electromagnetic relay 1 is implemented as a double coil latching relay. However, this is only an example and should not be construed as limiting. Alternatively, the contact device A1 of the electromagnetic relay 1 according to this embodiment is applicable to a single coil latching relay as well. Still alternatively, the contact device A1 of the electromagnetic relay 1 according to this embodiment is also applicable to a single stable relay.

Furthermore, in the embodiment described above, the electromagnetic relay 1 includes the electromagnetic device A10 and the card 80. However, this is only an example and should not be construed as limiting. Alternatively, the electromagnetic relay 1 may include no cards 80. In that case, the armature 60 and the moving contact holder 14 may be fixed together with an electrical insulator interposed between themselves.

(Resume)

As can be seen from the foregoing description, an electromagnetic relay (1) according to a first aspect includes a fixed contact holder (12), a moving contact holder (14), an electromagnetic device (A10), and a magnet (which may be at least one of magnets 17, 18). The fixed contact holder (12) extends in a predetermined direction and is provided with a fixed contact (11) at one end portion (121) thereof. The moving contact holder (14) also extends in the predetermined direction, is arranged to face the fixed contact holder (12), and is provided with a moving contact (13) at one end portion (141) thereof. The moving contact holder (14) moves between a closed position where the moving contact (13) comes into contact with the fixed contact (11) and an open position where the moving contact (13) goes out of contact with the fixed contact (11). The electromagnetic device (A10) displaces the moving contact holder (14) such that the moving contact (13) moves back and forth between the closed position and the open position. The magnet is arranged perpendicularly to an opening/closing direction of the fixed contact (11) and the moving contact (13). A stretch space (E1) is provided, in the predetermined direction, beyond respective tips of the fixed contact holder (12) and the moving contact holder (14). The stretch space (E1) is provided to face one surface (12*b*), out of two surfaces (12*a*, 12*b*), of the fixed contact holder (12) along the thickness thereof. The one surface (12*b*) of the fixed contact holder (12) is located opposite from the other surface (12*a*) thereof where the fixed contact (11) and the moving contact (13)

come into contact with each other. The stretch space (E1) is also provided to face one surface (14*b*), out of two surfaces (14*a*, 14*b*), of the moving contact holder (14) along the thickness thereof. The one surface (14*b*) of the moving contact holder (14) is located opposite from the other surface (14*a*) thereof where the fixed contact (11) and the moving contact (13) come into contact with each other. The stretch space (E1) is a space in which an arc generated between the fixed contact (11) and the moving contact (13) is stretched.

According to this configuration, the electromagnetic relay (1) provides the stretch space (E1) such that the arc, along which the respective holders are extended, is stretched in the space beyond the respective tips of the fixed contact holder (12) and the moving contact holder (14) and in a space facing the surface (12*b*) of the fixed contact holder (12) and a space facing the surface (14*b*) of the moving contact holder (14). This makes the arc long enough to be cut off with more stability than in a situation where the stretch space is provided along the width of the holders. This allows the arc to be cut off with stability and improves the cutoff ability of the electromagnetic relay (1).

In an electromagnetic relay (1) according to a second aspect, which may be implemented in conjunction with the first aspect, the magnet is arranged such that when viewed in a third axis direction, the fixed contact (11), the moving contact (13), the end portion (121) of the fixed contact holder (12), and the end portion (141) of the moving contact holder (14) overlap with a surface of the magnet. The third axis defines a direction perpendicular to both a first axis direction that is the predetermined direction and a second axis direction in which the fixed contact holder (12) and the moving contact holder (14) face each other According to this configuration, the electromagnetic relay (1) allows the magnet to stretch the arc, generated between the fixed contact (11) and the moving contact (13), toward upper and lower ends and right and left ends of the stretch space (E1), thus extending the arc length sufficiently. This further improves the cutoff ability of the electromagnetic relay (1).

An electromagnetic relay (1) according to a third aspect, which may be implemented in conjunction with the second aspect, further includes a second magnet (such as a magnet 18) arranged to face a first magnet (such as a magnet 17), provided as the magnet, so as to interpose, in the third axis direction, the fixed contact holder (12) and the moving contact holder (14) between the first magnet and the second magnet. One surface (17*a*), out of two surfaces (17*a*, 17*b*), of the first magnet faces the second magnet in the third axis direction. One surface (18*a*), out of two surfaces (18*a*, 18*b*), of the second magnet faces the first magnet in the third axis direction. The one surface (17*a*) of the first magnet has a different polarity from the one surface (18*a*) of the second magnet.

According to this configuration, the magnetic flux generated by the first magnet and the magnetic flux generated by the second magnet have the same orientation and enhance each other, thus increasing the Lorentz force acting on the arc. This further improves the cutoff ability of the electromagnetic relay (1). In addition, the surface (17*a*) of the first magnet and the surface (18*a*) of the second magnet having different polarities reduce the chances of the magnetic flux leaking out. This reduces the chances of the magnetic flux generated affecting the operation of another part (such as the electromagnetic device A10).

In an electromagnetic relay (1) according to a fourth aspect, which may be implemented in conjunction with any one of the first to third aspects, at least one contact (such as the fixed contact 11) selected from the group consisting of the fixed contact (11) and the moving contact (13) has a curved portion (11*b*) at a tip of at least one holder (e.g., the fixed contact holder 12) provided with the one contact. The at least one holder is selected from the group consisting of the fixed contact holder (12) and the moving contact holder (14).

This configuration allows the electromagnetic relay (1) to move an end point of the arc from a surface of the holder where the arc has been generated toward the opposite surface via the curved portion (11*b*). This allows the arc to be stretched toward a part of the stretch space (E1) facing opposite from the surface of the holder where the arc has been generated. Consequently, the arc length is extended sufficiently, thus further improving the cutoff ability of the electromagnetic relay (1).

In an electromagnetic relay (1) according to a fifth aspect, which may be implemented in conjunction with the fourth aspect, the one contact (such as the fixed contact 11) further includes a first contact portion (11*a*) and a second contact portion (11*c*). The first contact portion (11*a*) is bonded onto a first surface (surface 12*a*), out of two surfaces (12*a*, 12*b*), of the one holder (e.g., the fixed contact holder 12) along the thickness thereof. The first surface is a surface on which the fixed contact (11) and the moving contact (13) come into contact with each other. The second contact portion (11*c*) is brought into contact with a second surface (surface 12*b*), opposite from the first surface, of the one holder along the thickness thereof. The first contact portion (11*a*) and the second contact portion (11*c*) are continuous with each other via the curved portion (11*b*).

This configuration allows the electromagnetic relay (1) to move the end point of the arc from the first surface of the holder where the arc has been generated toward the opposite second surface via the curved portion (11*b*), and then through the lower end of the second contact portion (11*c*). This allows the arc to be stretched toward a part of the stretch space (E1) facing opposite from the surface of the holder where the arc has been generated and including the lower end of the second contact portion (11*c*). Consequently, the arc length is extended sufficiently, thus further improving the cutoff ability of the electromagnetic relay (1).

In an electromagnetic relay (1) according to a sixth aspect, which may be implemented in conjunction with the fifth aspect, the one contact (e.g., the fixed contact 11) is provided for the one holder (e.g., the fixed contact holder 12) such that a gradient of a tangential line drawn with respect to a surface of the one contact changes continuously from a point (contact region 5) where the one contact comes into contact with the other contact (e.g., the moving contact 13) toward a tip of the curved portion (11*b*).

This configuration allows the electromagnetic relay (1) to smoothly move the end point of the arc from the first surface of the holder where the arc has been generated toward the opposite, second surface via the curved portion (11*b*). Consequently, the arc length is extended sufficiently, thus further improving the cutoff ability of the electromagnetic relay (1).

In an electromagnetic relay (1) according to a seventh aspect, which may be implemented in conjunction with any one of the fourth to sixth aspects, the one contact (e.g., the fixed contact 11) is electrically connected to a negative electrode of an external DC power supply (DC power supply 2), and the other contact (e.g., the moving contact 13) is electrically connected to a positive electrode of the external DC power supply.

This configuration allows the end point of the arc to move from the surface of the holder where the arc has been generated toward the opposite surface via the curved portion (11*b*) at the negative electrode side contact from which the arc (or electrons) is discharged. This reduces the chances of the arc shorting while the arc is being stretched, thus cutting off the arc in a short time. This also reduces the wear of the contacts, thereby increasing the electrical durability of the electromagnetic relay (1). In addition, this also extends the arc length sufficiently to further improve the cutoff ability of the electromagnetic relay (1) as well.

In an electromagnetic relay (1) according to an eighth aspect, which may be implemented in conjunction with any one of the first to seventh aspects, the magnet is arranged such that Lorentz force acts in the predetermined direction on the arc between the fixed contact (11) and the moving contact (13).

This configuration allows the electromagnetic relay (1) to move the arc generated between the fixed contact (11) and the moving contact (13) toward the tips of the fixed contact holder (12) and moving contact holder (14) under the Lorentz force and then change the directions of arc toward the back surfaces of the fixed contact holder (12) and moving contact holder (14). This allows the arc to be stretched by being attracted toward the stretch space (E1). Consequently, this further improves the cutoff ability of the electromagnetic relay (1).

An electromagnetic relay (1) according to a ninth aspect, which may be implemented in conjunction with any one of the first to eighth aspects, further includes a case (C1) housing the fixed contact holder (12), the moving contact holder (14), and the electromagnetic device (A10). The case (C1) has an inner wall (C21) defining the stretch space (E1) and a space (D2) where the electromagnetic device (A10) is housed. The electromagnetic device (A10) includes a coil (20) and an armature (60) to be displaced by electromagnetic force generated when the coil (20) is energized. The moving contact holder (14) is displaced in synch with the armature (60). The inner wall (C21) of the case (C1) is provided between the moving contact holder (14) and the armature (60).

This configuration allows the electromagnetic relay (1) to prevent the arc generated between the contacts from reaching the armature along the inner wall (C21) while the arc is being stretched. In addition, this also prevents, even when abnormally high voltage is generated between the moving contact (13) and the armature (60), dielectric breakdown. Consequently, the contacts and the electromagnet are insulated from each other with reliability.

In an electromagnetic relay (1) according to a tenth aspect, which may be implemented in conjunction with the ninth aspect, the moving contact holder (14) is displaced by a card (80) moving in synch with the armature (60) and having electrical insulation properties. The card (80) is provided between the moving contact holder (14) and the armature (60).

This configuration allows the electromagnetic relay (1) to prevent the arc generated between the contacts from reaching the armature along the card (80) while the arc is being stretched. In addition, this also prevents, even when abnormally high voltage is generated between the moving contact (13) and the armature (60), dielectric breakdown. Consequently, the contacts and the electromagnetic device (A10) are electrically insulated from each other with reliability.

REFERENCE SIGNS LIST

1 Electromagnetic Relay
2 DC Power Supply (External DC Power Supply)
3 Load
6, 6*a*, 6*b*, 6*c* Arc
11 Fixed Contact (Contact)
11*a* First Contact Portion
11*b* Curved Portion
11*c* Second Contact Portion
12 Fixed Contact Holder
12*a* Surface (First Surface)
12*b* Surface (Second Surface)
13 Moving Contact (Contact)
14 Moving Contact Holder
14*a* Surface (First Surface)
14*b* Surface (Second Surface)
17, 18 Magnet
17*a*, 17*b*, 18*a*, 18*b* Surface
20 Coil
30 Bobbin
40 Iron Core
50 Yoke
60 Armature
70 Hinge Spring
80 Card
90 Magnet
121 End Portion
141 End Portion
142 End Portion
A10 Electromagnetic Device
C1 Case
C11 Cover
C12 Base
C21-C23 Inner Wall
C25 Inner Wall
F1-F10 Lorentz Force
D1 Space
E1 Stretch Space

The invention claimed is:

1. An electromagnetic relay comprising:

a fixed contact, a moving contact, a fixed contact holder extending in an upward/downward direction in a first axis and having a first end portion on an upper side of the first axis, the first end portion being provided with the fixed contact;

a moving contact holder also extending in the first axis, arranged to face the fixed contact holder, having a second end portion provided with the moving contact, and configured to move between a closed position where the moving contact comes into contact with the fixed contact and an open position where the moving contact goes out of contact with the fixed contact;

an electromagnetic device configured to displace the moving contact holder in a second axis orthogonal to the first axis such that the moving contact moves back and forth between the closed position and the open position; and a magnet having a polarity on a surface facing a first space between the fixed contact and the moving contact, wherein a fixed contact side terminal composed of the fixed contact and the fixed contact holder includes, a first surface facing the first space, a second surface facing a second space on the second axis opposite to the first space with the fixed contact side terminal sandwiched between the first space and the second space, and a curved portion curved so as to be convex upward at an upper end of the fixed contact side terminal, the first surface and the second surface are continuous with each other via the curved portion, the magnet is arranged so as to face a contact portion which includes the fixed contact, the moving contact, the first end portion, the second end portion and the curved portion, in a third axis orthogonal to both the first axis and the second axis.

2. The electromagnetic relay of claim 1, further comprising a second magnet arranged to face a first magnet, provided as the magnet, so as to interpose, in the third axis, the fixed contact holder and the moving contact holder between the first magnet and the second magnet, wherein one surface, out of two surfaces, of the first magnet faces the second magnet in the third axis, one surface, out of two surfaces, of the second magnet faces the first magnet in the third axis, and the one surface of the first magnet has a different polarity from the one surface of the second magnet.

3. The electromagnetic relay of claim 1, wherein the fixed contact includes:

a first fixed contact portion bonded onto a third surface, out of two surfaces, of the fixed contact holder along the thickness thereof, the third surface of the fixed contact holder being a surface on which the fixed contact and the moving contact come into contact with each other, and includes the first surface, a second fixed contact portion brought into contact with a fourth surface, opposite from the third surface, of the one holder along the thickness thereof, the fourth surface including the second surface; and the curved portion.

4. The electromagnetic relay of claim 3, wherein the fixed contact is provided for the fixed contact holder such that a gradient of a tangential line drawn with respect to a surface of the fixed contact changes continuously from a point where the fixed contact comes into contact with the moving contact toward an upper edge of the curved portion.

5. The electromagnetic relay of claim 1, wherein the fixed contact side terminal is provided such that a gradient of a tangential line drawn with respect to a surface of the fixed contact side terminal changes continuously from a point where the fixed contact side terminal comes into contact with the moving contact toward an upper edge of the curved portion.

6. The electromagnetic relay of claim 1, wherein the fixed contact is electrically connected to a negative electrode of an external DC power supply, and the moving contact is electrically connected to a positive electrode of the external DC power supply.

* * * * *